United States Patent [19]

Moser et al.

[11] 4,254,411

[45] Mar. 3, 1981

[54] DANGER ALARM SYSTEM

[75] Inventors: Otto W. Moser; Peer Thilo, both of Munich, Fed. Rep. of Germany

[73] Assignee: Siemens Aktiengesellschaft, Berlin & Munich, Fed. Rep. of Germany

[21] Appl. No.: 29,388

[22] Filed: Apr. 12, 1979

[30] Foreign Application Priority Data

Apr. 19, 1978 [DE] Fed. Rep. of Germany ..... 2817121

[51] Int. Cl.[3] ..... G08B 25/00

[52] U.S. Cl. ..... 340/517; 340/505

[58] Field of Search ..... 340/500, 505, 506, 517, 340/518, 531, 533, 540

[56] References Cited

U.S. PATENT DOCUMENTS

| | | | |
|---|---|---|---|
| 3,566,399 | 2/1968 | Weld | 340/505 |
| 3,588,892 | 6/1971 | Scheidweiler | 340/517 |
| 3,839,707 | 10/1974 | Woodward et al. | 340/505 |
| 4,021,796 | 5/1977 | Fawcett, Jr. et al. | 340/501 |
| 4,032,907 | 6/1977 | Young | 340/517 |

FOREIGN PATENT DOCUMENTS 2533382 10/1976 Fed. Rep. of Germany .

*Primary Examiner*—Alvin H. Waring

*Attorney, Agent, or Firm*—Hill, Van Santen, Steadman, Chiara & Simpson

[57] ABSTRACT

In a danger alarm system, such as a fire alarm system, the availability of the system is increased by decentralization of the system intelligence. For this purpose, the entire system is subdivided into small system modules which are fully functional in and of themselves. Each system module has connection installations for one or more alarm circuits or one or more subordinate system modules, a programmed control for interrogation and evaluation of alarm signals, as well as connections for display operation and registration elements. One of the system modules serves as the central station, as the remaining system modules are subordinate to the central station in one or more hierarchical levels.

2 Claims, 4 Drawing Figures

DANGER ALARM SYSTEM

CROSS REFERENCE TO RELATED APPLICATION

This application is related to an application, Ser. No. 029,834 of Schreyer et al and to an application, Ser. No. 029,831 of Schreyer et al, both filed Apr. 13, 1977.

BACKGROUND OF THE INVENTION

1. Field of the Invention

The present invention relates to a danger alarm system having a plurality of alarm circuits which are connectible, via call lines, to a central station in which the state of the individual alarm circuits can be determined in the exchange via testing devices and can be displayed by way of an evaluation of the individual alarm signals can be executed by way of a programmed control.

2. Description of the Prior Art

In security alarm systems, it is essential that faulty system parts be recognized and indicated. In addition, the system should be available i.e. be operational, as permanently and completely as possible. In conventional systems, for each call circuit a separate central component group is usually required which contains both evaluation and display elements and simply feeds alarm and interference reports to a superordinate common display or registration. The amount of information to be processed increases because of the constantly increasing number of alarm circuits and types of alarm circuits connected to an alarm system, and also because of the further development toward more and more accurate alarm circuits which display on an analogue basis. Thereby, increasing numbers of component groups are required, which at the same time leads to an increase of failure risk because of the increasing plurality of component parts.

In newer systems, a central data processing system is often employed for the processing of the greater amount of information, and also for the reduction of the number of component parts. Connected therewith, however, is the specific risk that the central component groups should at some time become inoperative, which would result in the failure of the entire alarm system.

SUMMARY OF THE INVENTION

The object of the present invention is to provide the advantages of a programmed control for interrogation and evaluation of alarm signals, and at the same time to maintain the failure risk of such a control as low as possible or, respectively, to limit the failure risk to as small a part of the system as possible.

The above object is achieved, according to the present invention, in a danger alarm system of the type generally mentioned above in that the system is formed of a plurality of individual system modules, in which each system blocks possesses connection installations for one or more alarms or, respectively, for one or more subordinate system modules, a programmed control for interrogation and evaluation of the incoming alarm signals, as well as connections for display, operating and registering elements. The system modules are connected among one another with lines in such a manner that one of the system modules can be employed as a central exchange while the remaining system modules are allocated to the central exchange as junctions in one or more hierarchical levels.

In an alarm system constructed in accordance with the present invention, the availability is increased by means of the decentralization of the system intelligence. Therefore, the entire system is subdivided into small system modules which are fully functional per se, whereby each of the modules has its own control, preferably a microprocessor. The individual control of a system module controls all logical sequences and simultaneously processes the occurring alarm information. Each system module has a number of mounting locations into which the connecting component groups for the most various types of alarm circuits can be inserted. Thereby, all mounting locations of a system block can be connected to one another by means of an universal line bus; in this case, alarm connecting component groups can be plugged-in in any desired arrangement. Advantageously, each system module is fed from its own power supply.

Moreover, the connecting installations in each system module can have a simple interruption and alarm display for the connected alarm circuits or respectively subordinated system modules paralles to the programmed control. This serves as a type of emergency program, so that, upon failure of the processor, danger reports can still be recognized on the alarm connection.

BRIEF DESCRIPTION OF THE DRAWINGS

Other objects, features and advantages of the invention, its organization construction and operation will be best understood from the following detailed description, taken in conjunction with the accompanying drawings, on which.

DESCRIPTION OF THE PREFERRED EMBODIMENTS

Figure 1:
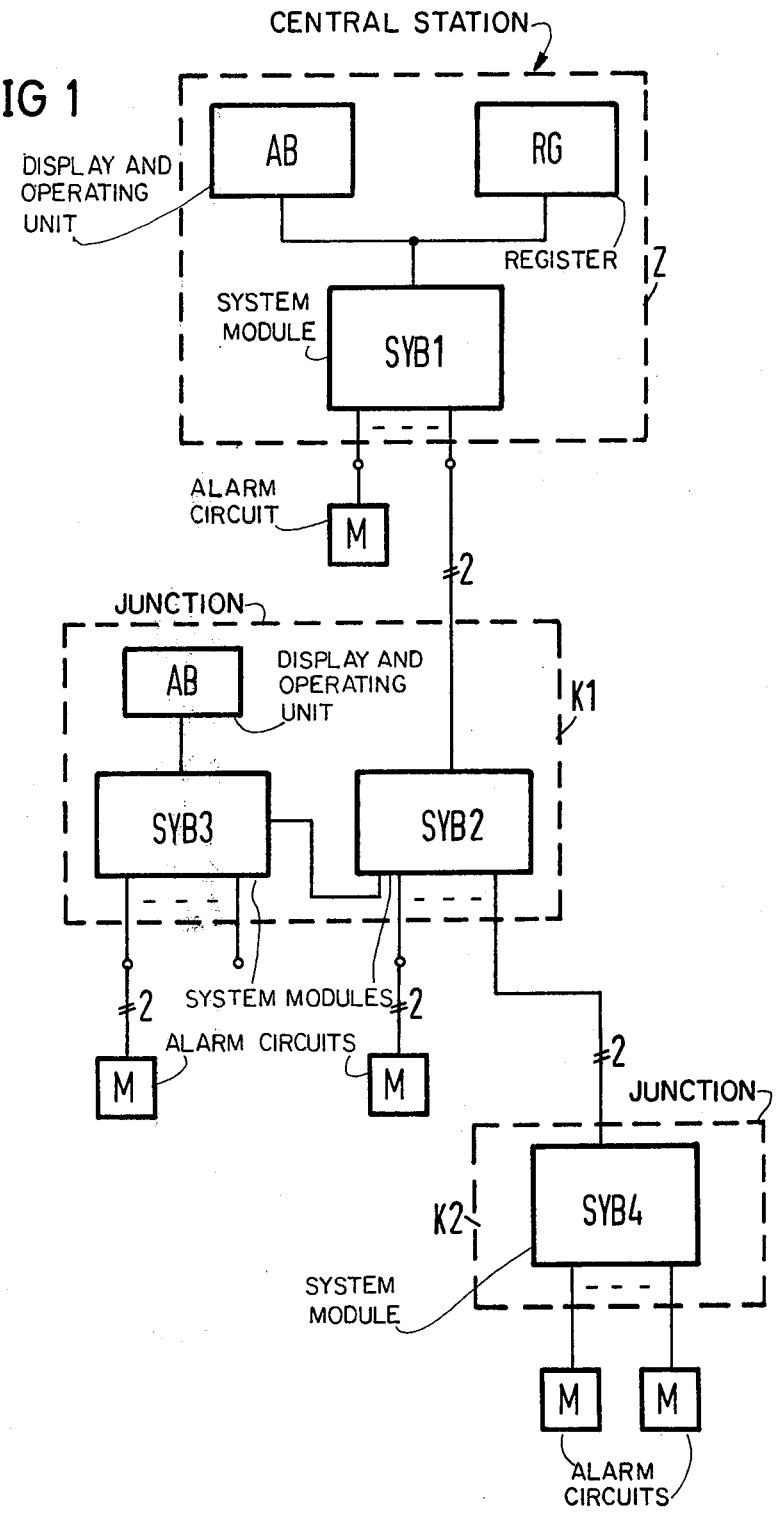
FIG. 1 is a block diagram of a danger alarm system constructed in accordance with the present invention.

Referring to FIG. 1, a danger alarm system is illustrated as comprising a plurality of system modules SYB. One of the system modules, the system module SYB1, is arranged as a central exchange Z. It contains a programmed control for the evaluation of the signals arriving from the connected alarm circuits M and the connected, subordinate junctions K, of which junctions K1 and K2 are illustrated on the drawing. In general, this programmed control is a microprocessor. Moreover, a display and operating unit AB, for example a video data terminal, as well as a registered unit RG, for example a printer, are connected to the system module SYB1.

The junctions K1 and K2 are connected to the central exchange Z. The junction K1, for example, contains a system module SYB2, to which, in turn, the system modules SYB3 and SYB4 are hierarchically subordinate. Thereby, the subordinate system modules can be incorporated in the same junction K1, or in a remote junction K2. The connection of the subordinate system modules is carried out in the same manner as the connection of the alarm circuits M via two-wire lines. Each system module can be equipped with display and operating elements AB, and also with registration devices RG, as required by the particular installation.

Figure 2:
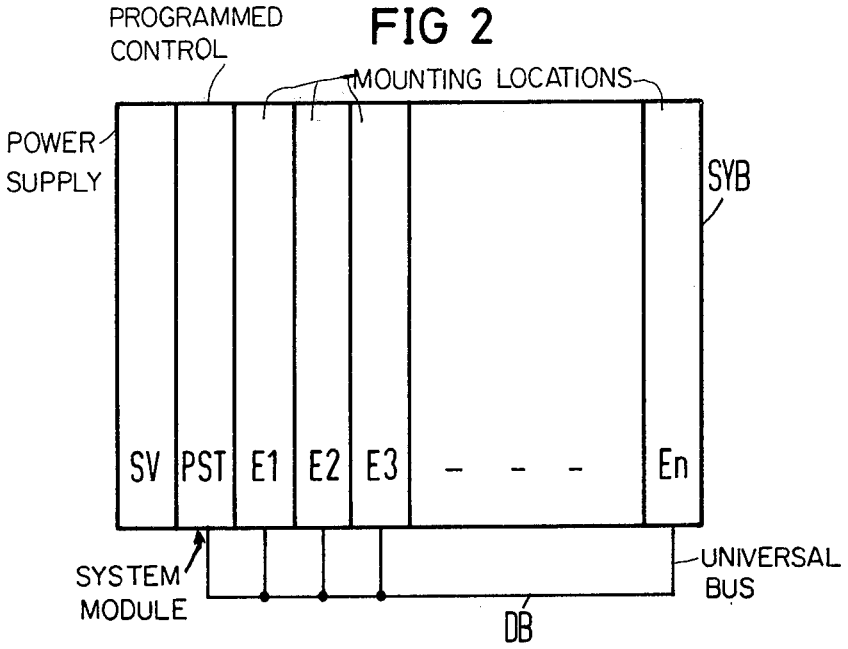
FIG. 2 is a diagram of an individual module.

The diagram of a system module is illustrated FIG. 2. The system module SYB contains a power supply component group SV and a programmed control PST, which in general formed by means of a microprocessor. In addition, the system module has a plurality of mounting locations E1–En for alarm connection or for input and output component groups. All mounting locations are connected to one another and to the programmed control by way of a universal bus DB. This means that alarm connections to which, again, a plurality of lines can be connected, may be plugged-in in any desired arrangement.

Figure 3:
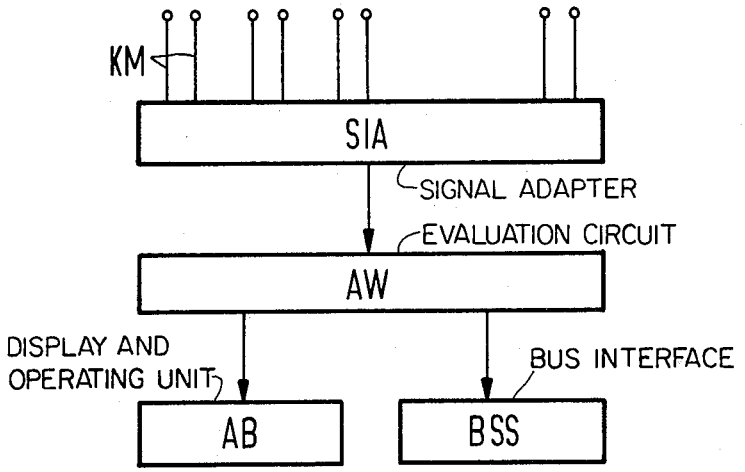
FIG. 3 is a block diagram of possible alarm connection.

FIG. 3 illustrates a block circuit diagram of an alarm connection as it can be located, for example, in a mounting location E1–En. For example, in a mounting location E1–En. For example, the individual call lines with the connected alarm circuits can be connected to the terminals KM. Subordinated system modules, also, are connected to the terminals KM. The incoming alarm signals are brought into a processable form in a signal adapter SIA, for example converted into pulses. Such a conversion of current measurement into pulses is illustrated, for example, in the German published and allowed application No. 2,533,382. An evaluation circuit AW contains, in general, a comparator circuits in which the alarm signals are compared with reference values and are processed for the formation of interrupt signals or alarm signals. These conditions can be displayed in a display and operating unit AB or can be relayed by way of a bus interface BSS.

Figure 4:
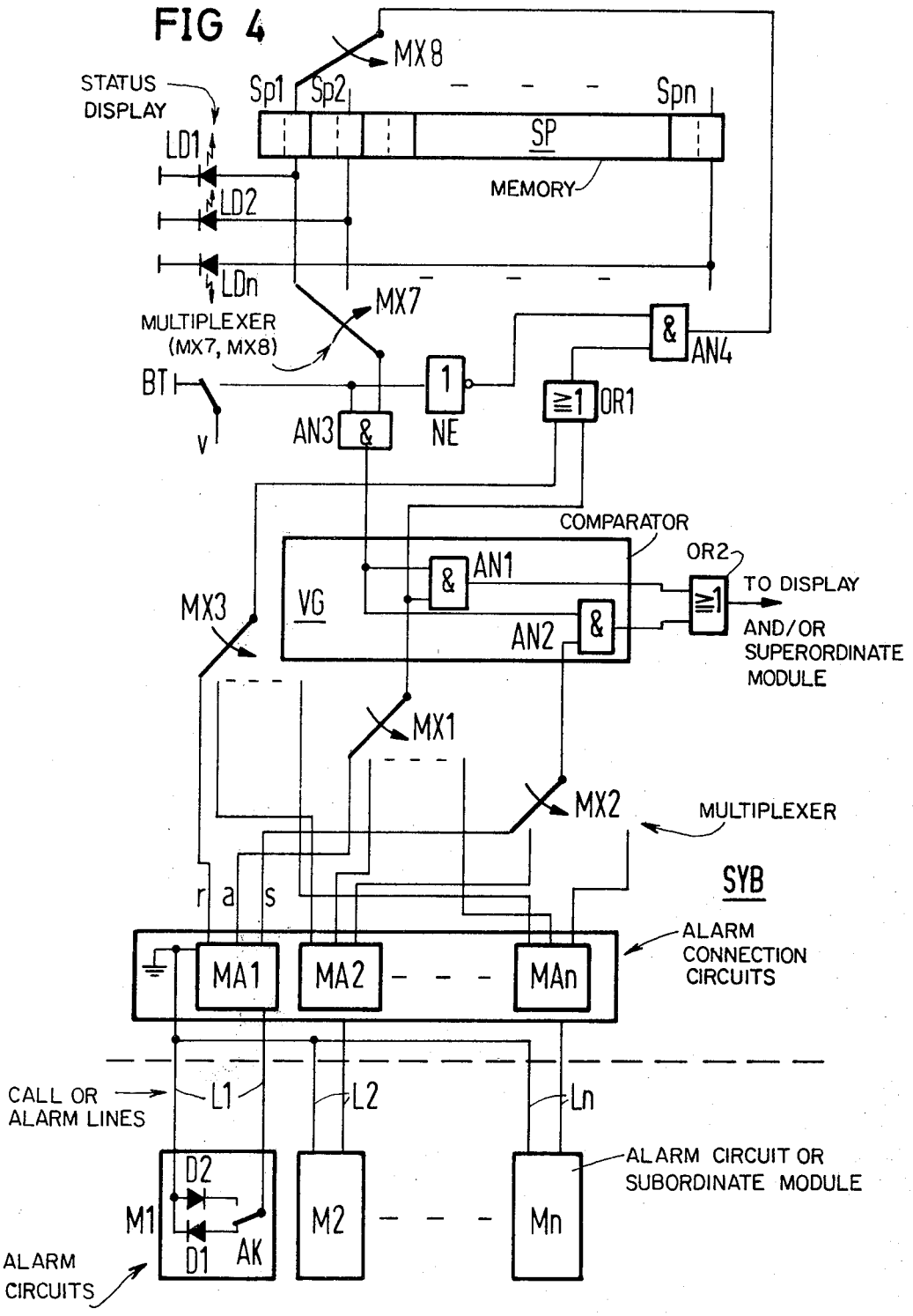
FIG. 4 illustrates a circuit arrangement which may be provided for a system module.

For a more detailed explanation of the operation of a system block, references taken to FIG. 4 which illustrates a possible circuit arrangement having the logical linkages such as, for example, may be carried out by a programmed microprocessor. Individual call lines L1–Ln are connected to the system module SYB and have respective alarm circuits M1–Mn connected to the distal ends thereof. The call lines are respectively connected in the system module SYB to alarm connection circuits MA1–MAn which operate to monitor the state of the alarm circuits and the lines. An alarm connection circuit, for example the circuit MA1, provides a signal r for a quiescent state, a signal a for an alarm state, or a signal s for an interruption report and provides such signals at respective outputs.

For the sake of simplicity, the employment of diode alarm is assumed, as illustrated in the alarm circuit M1; therefore, the alarm signals are derived in the following manner:

(1) an alternating current or a direct current with changing polarity is delivered from the alarm connection circuit MA1 to the call line L1 and as long as the alarm switch AK is in the diode D1 and produces the quiescent signal r in the alarm connection circuit MA1;

(2) when the alarm switch K is operated to the opposite position, the other half-wave of the current flows via the diode D2 and produces the alarm signal a in the alarm connection circuit MA1; and (3) upon interruption of conductivity, absolutely no current can flow via the alarm circuit M1, and this condition is evaluated in the alarm connection circuit MA1 as an interrupt signal s.

The interrupt signal s is also generated when both half-waves can be received because of a line short circuit. When no alarm circuit is connected to the line, this would likewise be reported as an interrupt signal it appropriate precautionary measures were not taken. A corresponding evaluation circuit, such as the alarm connection circuit MA1, is described in the German allowed and published application No. 2,114,537, and is illustrated in FIG. 2 thereof. The output signals of the alarm connection circuits MA1–MAn are synchronously interrogated by of a multiplex interrogation device, and, in particular, the alarm signal a by way of an interrogation device MX1 the interrupt signal s by way of an interrogation device MX2 and the quiescent signal r by way of an interrogation device MX3. The sequentially output alarm signals a and interrupt signals s are respectively relayed, via a comparator VG as output signals of the system block SYB. This can either occur directly to a display unit connected to the system module or, via a two-wire line, to a superordinate system module.

The sequentially occurring interrupt and alarm signals can be delivered by way of an OR gate OR 2 to a common output line. The signals for the individual call lines can then be output in parallel to a display device by means of a multiplexer that can be synchronously operated with the interrogation multiplexer MX1, MX2 and MX3.

In order to undertake an evaluation of alarm and interrupt signals, only when the line concerned is actually busy, in the present example a memory SP is further provided and includes individual memory location SP1–Spn are respectively assigned to the call lines and in which the busy or free state of a call line can be stored. The memory locations Sp1–Spn are scanned synchronously with the alarm connection circuits via a multiplexer MX7 and the signals respectively read from the memory locations are compared with the incoming interrupt or alarm signals in the comparator VG. Such an alarm signal is only relayed via the coincidence elements AN1 and AN2, which may be AND gates, when the memory location concerned is characterized as busy. For automatic writing of the busy state of each line into the memory SP, and input multiplexer MX8 is provided which also sequences in synchronism with the multiplexers MX1, MX2 and MX3. If, now, the actual state of the alarm system is to be determined and stored i.e. upon placing the system into operation, first the operational switch BT is open. The AND gates AN1 and AN2 are blocked by way of the AND gate AN3 and prevent the signals emitted by the alarm connection circuits to pass as output signals. On the other hand, a busy state is respectively written into the memory SP via OR1 and AND gate AN4 when a quiescent signal r or an alarm signal a is reported by the alarm connection circuits MA1–MAn, respectively. In these instances, an alarm circuit is connected to the call line concerned.

When an interrupt signal s is reported, then a logic "zero" is written into the respective memory location Sp, i.e. that the alarm line concerned is characterized as not busy. When the entire memory SP is recorded, then the actual state of the system can be tested via a display installation having light-emitting diodes LD1–LDn. When this condition is deemed to be correct, then the system can be placed in operation by operating the switch BT to its opposite position. Now, the AND gate AN4 is blocked by way of an inverter NE so that the memory state can no longer be changed. Interrupt signals s or alarm signals a are only relayed via the AND gates AN1 and AN2 when the memory location concerned is read as being busy.

As mentioned above, the functions illustrated in FIG. 4 can be undertaken by a programmed microprocessor having a connected memory. Thereby, in particular, other alarm circuits, thus for example alarm circuits which display in analogue fashion, can also be evaluated and compared with reference values formed in the microprocessor. Since each system module SYB is equipped in the same manner with a microprocessor, a data traffic between the individual modules is possible via a standardized, serial interface upon employment of a single pair of wires.

Therefore, in an alarm system constructed in accordance with the present invention, there is provided a higher availability because of the subdivision in program-controlled function units having few component parts which are independent of one another, by means of alarm connection component groups which are independent of one another and are functional without a processor, as well as by means of interruption-free data transmission between the individual system modules which function with few wires. The failure of a component group cannot lead to the failure of the entire system. Even upon failure of the superordinate modules remain fully functional.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A danger alarm system comprising:

a plurality of similar system alarm modules;

a plurality of two-wire lines connecting said system alarm modules in a hierarchical system including at least one system alarm module as a central station and a plurality of others of said system alarm modules defining, in said hierarchical system, subordinate and superordinate levels;

each of said system alarm modules including a plurality of connections for receiving alarm signals from respective alarm devices and from at least one subordinate system alarm module;

each of said system alarm modules including connections for display, operating status and recording devices;

each of said system alarm modules including a programmed control comprising a microprocessor for scanning and evaluating incoming signals of the alarm devices and subordinate system alarm modules, and means for transmitting the evaluated signals to a superordinate module;

each of said system alarm modules including a respective power supply; and each of said system alarm modules including a quiescent-interrupt and alarm display connected in parallel to said programmed control.

2. A danger alarm system comprising:

a plurality of similar system alarm modules;

a plurality of two-wire lines connecting said system alarm modules in a hierarchical system including at least one system alarm module as a central station and a plurality of others of said system alarm modules defining, in said hierarchical system, subordinate and superordinate levels;

each of said system alarm modules comprising a plurality of alarm connection circuits for connection to alarm lines including subordinate system alarm modules receiving and identifying quiescent, interrupt and alarm conditions on such lines, a multiplexer for scanning said alarm connection circuits, storage means for storing the busy-free state of the alarm lines, means connected to said multiplexer for storing the busy-free state of the alarm lines in said storage means, a display unit, and means comparing the busy-free state and the interrupt and alarm states to emit corresponding danger signals to said display unit and to a superordinate system alarm module.

* * * * *